United States Patent [19]

Collins et al.

[11] Patent Number: 4,713,947

[45] Date of Patent: Dec. 22, 1987

[54] COMFORT RING

[76] Inventors: William K. Collins, 479 Middle Drive Rd. 6, Bridgeton, N.J. 08302; George Spector, 233 Broadway RM 3815, New York, N.Y. 10007

[21] Appl. No.: 25,373

[22] Filed: Mar. 13, 1987

[51] Int. Cl.[4] ..... D04B 35/00; D04B 37/00

[52] U.S. Cl. ..... 66/1 A; 242/147 R; 242/157 R; 63/15.6

[58] Field of Search ..... 66/1, 1 A, 125, 3, 4; 242/157, 147; 63/15.6, 15.63, 15

[56] References Cited

U.S. PATENT DOCUMENTS

| | | | |
|---|---|---|---|
| 2,133,221 | 10/1938 | White | 242/157 R |
| 2,142,608 | 1/1939 | Hockert | 242/149 |
| 2,513,851 | 7/1950 | Dodds | 242/147 |
| 4,037,433 | 7/1977 | Weber | 242/147 X |
| 4,370,870 | 2/1983 | Kron et al. | 66/1 A |

*Primary Examiner*—Ronald Feldbaum

[57] ABSTRACT

A split crochetting ring is provided and consists of a shank having a spring biased split bight and terminating in a pair of offset upper ends. A pair of guide members are provided. Each guide member is mounted on a plate on each upper end of the shank and are opposed at z right angle to each other. Yarn is fed by hand therethrough for a fabric forming process such as crochetting and the like. In a modification the split crochetting ring includes an expandable locking shank.

4 Claims, 7 Drawing Figures

COMFORT RING

BACKGROUND OF THE INVENTION

The instant invention relates generally to finger rings and more specifically it relates to a split crochetting ring.

Numerous finger rings have been provided in prior art that are adapted to be adjustable in order to properly fit fingers of different sizes. For example U.S. Pat. Nos. 307,869; 3,433,032 and 4,223,541 all are illustrative of such prior art. While these units may be suitable for the particular purpose to which they address, they would not be as suitable for the purposes of the present invention as heretofore described.

SUMMARY OF THE INVENTION

A primary object of the present invention is to provide a split crochetting ring that will overcome the shortcomings of the prior art devices.

Another object is to provide a split crochetting ring that is adapted for making it more comfortable and effective in feeding yarn from the hand for fabric forming processes such as crochetting and the like.

An additional object is to provide a split crochetting ring that is expandable so as to be especially utilized for persons with arthritic and otherwise tender fingers.

A further object is to provide a split crochetting ring that is simple and easy to use.

A still further object is to provide a split crochetting ring that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
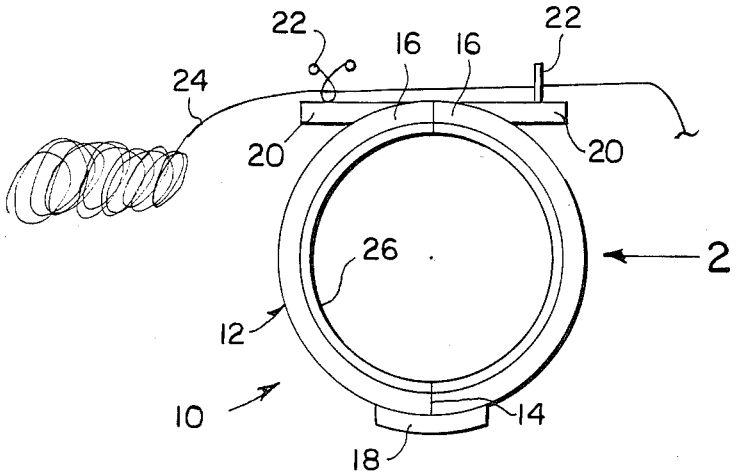
FIG. 1 is a side elevational view of the Invention.
Figure 2:
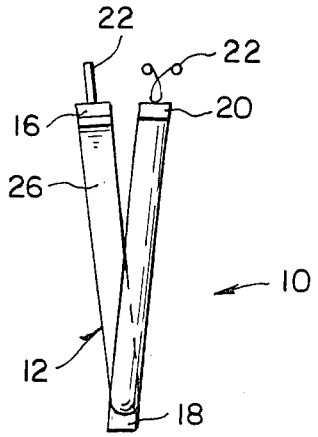
FIG. 2 is an end elevational view taken in direction of arrow 2 in FIG. 1.

Turning now descriptively to the drawings, in which similar reference characters denote similar elements throughout the several views, FIGS. 1 and 2 illustrates a split crochetting ring 10 consisting of a shank 12 having a split bight 14 and terminating in a pair of offset upper ends 16 with a flat spring 18 mounted across the split bight 14. A pair of plates 20 and a pair of guide members 22 are also provided. Each of the plates 20 is mounted to one side of one of the offset upper ends 16 of the shank 12 whereby when the plates 20 are squeezed longitudinally towards each other, the shank 12 will open wider to allow the ring 10 to slip onto a finger (not shown). Each of the guide members 22 is mounted to one of the plates 20. The guide members 22 are opposed at a right angle to each other so that yarn 24 can be feed by hand therethrough for a fabric forming such as crochetting and the like.

Figure 3:
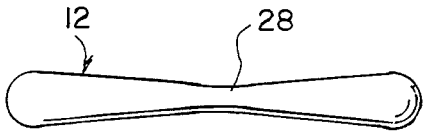
FIG. 3 is an end view showing a tapered shape to shank for easy fit.
Figure 4:
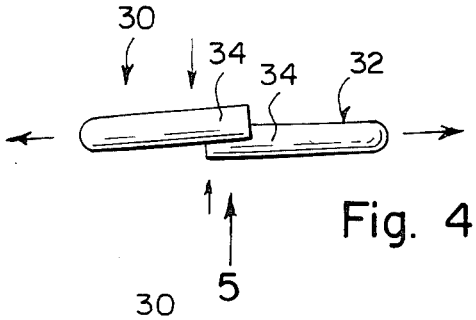
FIG. 4 is a top view of a modification having an expandable locking shank.
Figure 5:
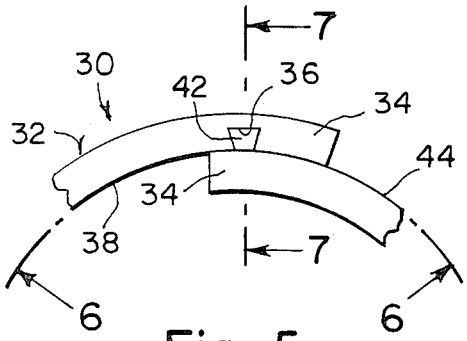
FIG. 5 is a side view with parts broken away taken in direction of arrow 5 in FIG. 4 showing the track and follower therein.
Figure 6:
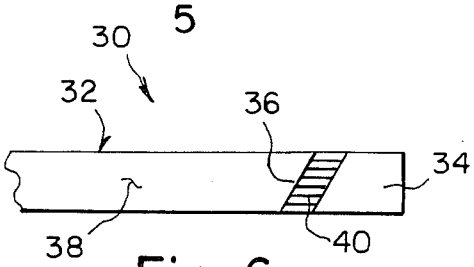
FIG. 6 is a bottom view with parts broken away taken along line 6—6 in FIG. 5 showing the angular position of the track.
Figure 7:
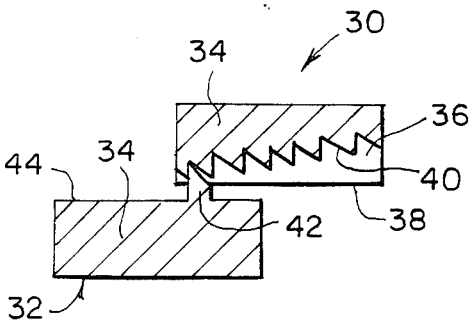
FIG. 7 is an enlarged cross sectional view taken along line 7—7 in FIG. 5 showing the teeth within the track in greater detail.

A rubber liner 26 is affixed within the shank 12 so as to prevent that shank from slipping and turning on the finger when the yarn 24 is fed therethrough. The shank 12, as shown in FIG. 3, includes a tapered shape 28 at sides thereof for easier fit onto the finger. The purpose of the ring 10 is to help women and in some cases men to control the flow of the yarn 24 with greater comfort instead of the yarn wrapping around the finger. The ring 10 is especially utilized for persons with arthritic and otherwise tender fingers.

FIGS. 4 through 7 show a modified split crochetting ring 30 consisting of a flexible shank 32 terminating in a pair of offset upper ends 34. A track 36 is formed upwardly into and extending angularly across underside 38 of one of the upper ends 34 of the shank 32. The track 36 has a plurality of serrations 40 therein.

A ratchet follower 42 is formed on top 44 of other of the upper ends 34 of the shank 32. The ratcher follower 42 is engageable and locked within the serrations 40 whereby when the upper ends 34 are squeezed latitudinally towards each other and arcuate movement is provided in which the shank 32 will open wider to allow the ring 30 to slip onto a finger (not shown).

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A split crochetting ring comprising:

(a) a shank having a split bight and terminating in a pair of offset upper ends;

(b) a flat spring mounted across said split bight of said shank;

(c) a pair of plates, each of which is mounted to one side of one of said offset upper ends of said shank whereby when said plates are squeezed longitudinally towards each other, said shank will open wider to allow said ring onto a finger; and (d) a pair of guide members, each of which is mounted on one of said plates, said guide members being opposed at a right angle to each other so that yarn can be fed by hand therethrough for a fabric forming process such as crochetting and the like.

2. A split crochetting ring as recited in claim 1, further comprising a rubber liner affixed within said shank so as to prevent said shank from slipping and turing on the finger when the yarn is fed therethrough.

3. A split crochetting ring as recited in claim 2, wherein said shank includes a tapered shape at sides thereof for easier fit onto the finger.

4. A split crochetting ring comprising:

(a) a flexible shank terminating in a pair of offset upper ends;

(b) a track being formed upwardly into and extending angularly across underside of one of said upper ends of said shank, said track having a plurality of serrations therein; and (c) a ratchet follower being formed on top of other of said upper ends of said shank, said ratchet follower being engageable and locked within said serrations whereby when said upper ends are squeezed latitudinally towards each other an arcuate movement is provided in which said shank will open wider to allow said ring to slip onto a finger.

* * * * *